US008245506B2

(12) United States Patent
Leroy

(10) Patent No.: US 8,245,506 B2
(45) Date of Patent: Aug. 21, 2012

(54) COMPOSITE EXHAUST MANIFOLD

(75) Inventor: Vincent Leroy, Montbeliard (FR)

(73) Assignee: Faurecia Systemes d'Echappement, Nanterre (FR)

( * ) Notice: Subject to any disclaimer, the term of this patent is extended or adjusted under 35 U.S.C. 154(b) by 511 days.

(21) Appl. No.: 12/297,159

(22) PCT Filed: Mar. 28, 2007

(86) PCT No.: PCT/FR2007/000533
§ 371 (c)(1),
(2), (4) Date: May 12, 2009

(87) PCT Pub. No.: WO2007/118969
PCT Pub. Date: Oct. 25, 2007

(65) Prior Publication Data

US 2009/0241528 A1 Oct. 1, 2009

(30) Foreign Application Priority Data

Apr. 14, 2006 (FR) ..... 06 03372

(51) Int. Cl.
*F01N 13/10* (2010.01)

(52) U.S. Cl. ..... 60/322; 60/323

(58) Field of Classification Search ..... 60/321, 60/322, 323; 277/606, 607, 644; 285/111
See application file for complete search history.

(56) References Cited

U.S. PATENT DOCUMENTS 4,593,916 A * 6/1986 Laulhe et al. ..... 277/637
5,505,498 A * 4/1996 Halling et al. ..... 285/111
6,155,046 A * 12/2000 Kato et al. ..... 60/323

FOREIGN PATENT DOCUMENTS

EP 0 171 624 2/1986
EP 0 340 946 11/1989
EP 0 696 677 2/1996
WO WO 2005/091902 10/2005

OTHER PUBLICATIONS

International Search Report (Form PCT/ISA/210) of Aug. 17, 2007.

* cited by examiner

*Primary Examiner* — Thomas Denion
*Assistant Examiner* — Jonathan Matthias
(74) *Attorney, Agent, or Firm* — Young & Thompson

(57) ABSTRACT

This exhaust manifold comprises: an outer envelope comprising: at least one flange connected to the outer shell and having at least one gas circulation port, the outer envelope having at least one gas circulation port; at least one internal duct (31) arranged inside the outer envelope and opening via a gas circulation port, characterized in that: the or each internal duct (31) is formed, at least for the most part of its length, of a ceramic material and is engaged through the or each port; and it comprises an annular diaphragm (34) that is impermeable to the gases but radially and axially elastically deformable and positioned around the or each internal duct (31), between the or each internal duct (31) and the outer envelope (18), the diaphragm (34) being connected at its periphery to at least one out of the outer envelope (18) and the or each internal duct (20, 31).

15 Claims, 2 Drawing Sheets

COMPOSITE EXHAUST MANIFOLD

The present invention relates to an exhaust manifold for an exhaust line of an internal combustion engine, of the type comprising:

an outer envelope comprising:

at least one flange connected to the outer shell and having at least one gas circulation orifice, the outer envelope having at least one gas circulation orifice;

at least one internal duct arranged inside the outer envelope and opening via a gas circulation orifice.

BACKGROUND OF THE INVENTION

Vehicles with heat engines are nowadays equipped with exhaust lines that include pollution control members such as catalytic purification members and/or particle filters. In order to permit satisfactory operation of such pollution control members it is necessary for the exhaust gases to reach them at a high temperature. It is therefore expedient to avoid too great a loss of heat in the exhaust line and especially in the manifold separating the outlet of the heat engine from the first pollution control member.

Various solutions have been envisaged to that end. In particular, manifolds comprising internal ducts maintained in an outer shell separated from the internal ducts by an air space or an insulating material are found to be effective in avoiding too great a loss of heat.

Such manifolds comprise a flange for fixing to the cylinder head of the engine, on which there come to bear on the one hand the internal ducts and on the other hand the outer shell. An outlet flange is also fixed to the outer shell, allowing the remainder of the exhaust line, and especially the turbocompressor, to be assembled.

Tightness for that type of assembly is ensured by the tight welding of the outer shell to the cylinder-head flange and the outlet flange.

The object of the invention is additionally to achieve satisfactory tightness between the internal ducts and the flanges, especially the outlet flange.

Such tightness is necessary when a material is used between the internal ducts and the outer shell, especially in the case of insulating materials or holding elements based on ceramics fibres, in order to prevent all or some of the material from being sucked in either by the engine or by the exhaust line, and especially the turbocompressor.

Connection and tightness between the internal ducts and the flanges are tricky to achieve because of the differential expansions, especially axial expansions, that are noted between the internal ducts and the outer shell. It is in fact impossible to connect the outer shell and the internal ducts rigidly to the cylinder-head and outlet flanges.

The object of the invention is to propose an exhaust manifold having a satisfactory connection and satisfactory tightness between the internal ducts and the outlet flange.

Tightness in the region of the cylinder-head flange is in that case assumed to be satisfactory and the connection with the flange is considered to be rigid.

The invention therefore proposes to achieve satisfactory tightness on the outlet flange side without imposing a rigid connection between the internal ducts and that flange.

SUMMARY OF THE INVENTION

This invention relates particularly to exhaust manifolds in which the internal ducts are brought together in a tight manner especially in a single outlet duct. However, it is possible to keep the ducts separate as far as the flange by adding a sealing element between the various ducts by adhesive bonding, for example, or with the aid of a gasket.

To that end, the invention relates to a manifold of the above-mentioned type, characterized in that:

the or each internal duct is formed, at least over the main part of its length, of a ceramics material and is engaged through the or each orifice; and it comprises an annular diaphragm which is impermeable to gases and is radially and axially deformable in a resilient manner and which is arranged around the or each internal duct between the or each internal duct and the outer envelope, the diaphragm being connected at its periphery to at least one of the outer envelope and the or each internal duct.

According to particular embodiments, the manifold has one or more of the following characteristics:

the outer envelope comprises an outer shell and a flange which is connected to the outer shell and delimits the or each gas circulation orifice;

the diaphragm is connected at its periphery to the other of the flange and the or each internal duct;

the diaphragm is resiliently pressed, at its periphery, against the other of the flange and the or each internal duct;

the diaphragm comprises, on the one hand, a skirt having an annular region for connection to the other of the flange and the or each internal duct and an annular profile for abutment on the other of the flange and the or each internal duct and, on the other hand, a resilient, radially acting member which is pressed against said annular profile in order to hold it, under radial stress, against the other of the flange and the or each internal duct;

the resilient member comprises a resilient ring which encircles said annular profile and presses it, by an action directed towards the centre, against the internal duct;

the resilient member encircling said annular profile exerts an action directed towards the centre on the annular profile against the internal duct, the intensity of which action is less than that of the discharge pressure of the space between the internal duct and the outer shell;

said profile defines an annular channel which is open to the outside and contains said resilient member;

said channel has two converging edges which delimit an opening whose width is less than the maximum width of the channel;

the diaphragm is in the form of a bellows;

the diaphragm is generally tapered;

the diaphragm comprises one or more discharge vent(s);

the diaphragm is connected by welding;

at least part of the space delimited between the outer shell and the or each internal duct contains a filling material; and the diaphragm is connected at its periphery to the outer envelope.

BRIEF DESCRIPTION OF THE DRAWINGS

The invention will be better understood upon reading the following description, which is given solely by way of example and with reference to the drawings, in which.

DETAILED DESCRIPTION OF THE PREFERRED EMBODIMENTS

Figure 1:
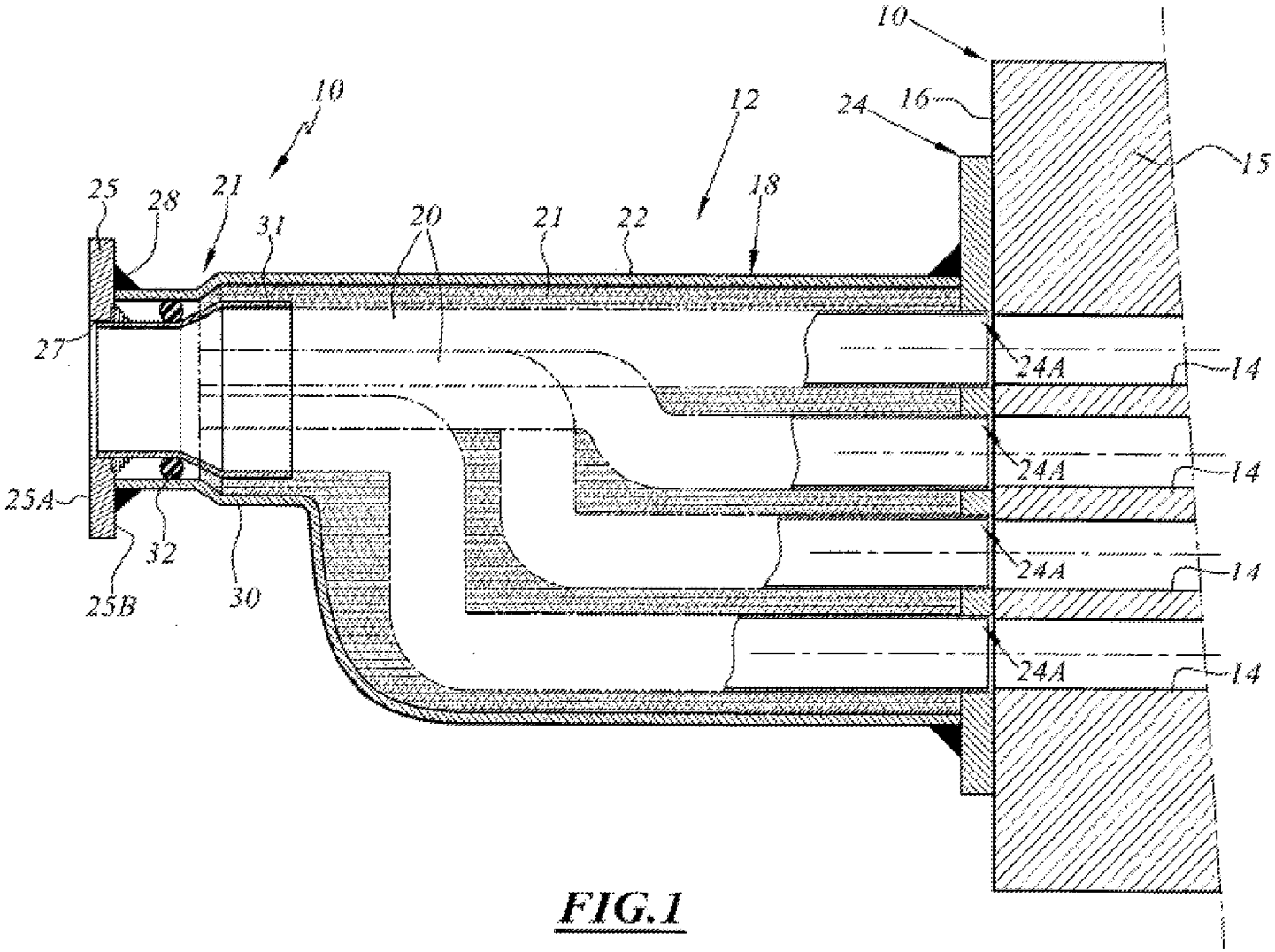
FIG. 1 is a top view, partially cut away, of an exhaust manifold according to the invention associated with the outlet flange.

FIG. 1 shows a heat engine 10 coupled to an exhaust manifold 12. The heat engine comprises, for example, four cylinders, each of which has an associated valve duct 14 forming an exhaust outlet provided through a cylinder head 15 of the engine.

The four outlets 14 open in the same plane 16 of the cylinder head, to which plane the inlet of the exhaust manifold 12 is fixedly joined.

The manifold 12 substantially comprises a tight outer envelope 18 in which there are accommodated four tubes 20 forming internal ducts for evacuating the exhaust gases. Each tube is associated with an exhaust outlet of a cylinder of the heat engine 10.

A holding material and/or a heat-insulating material, formed especially by a layer of ceramics fibres, fills at least part of the space 21 delimited between the envelope 18 and the tubes 20.

The envelope 18 comprises an outer shell 22 which surrounds the totality of the tubes 20, a flange 24 for connecting the manifold to the cylinder head 15 of the engine, and an outlet flange 25 which serves to connect the manifold to the remainder of the exhaust line and especially to a turbocompressor.

The outer shell 22 is formed, for example, by two metal half-shells which are joined together by a median peripheral weld. The shell defines a profile which converges from the flange 24 towards an end equipped with the outlet flange 25.

The flange 24 is formed by a solid plate which has four inlet orifices 24A arranged opposite the evacuation outlets 14 of the engine. It further comprises holes for the passage of screws for fixing the manifold to the cylinder head.

Each tube 20 passes through the flange 24 over substantially its entire length through an orifice 24A.

The outlet flange 25 has a main outer face which forms a surface for abutment 25A especially on the turbocompressor and an opposing inner surface 25B, between which there is formed a through-orifice 27. The outer shell 22 is fixed to the inner surface 25B by an external weld 28.

The internal tubes 20 are formed of a ceramics material, for example those described in patent applications U.S. Pat. No. 6,134,881, U.S. Pat. No. 6,161,379, U.S. Pat. No. 6,725,656 and WO-2004/106705. Those materials comprise a composite matrix which is based on inorganic polymer and reinforced by fibres, preferably ceramics fibres. Such materials are particularly suitable owing to their low thermal inertia, their low thermal expansion as compared with metal, especially a stainless steel, their mechanical properties, which allow them to withstand the flow of hot gases present in the exhaust and the vibrational stresses characteristic of motor vehicles, and, finally, owing to their high-temperature resistance in respect of the hot gases leaving an internal combustion engine.

The thickness of the tubes 20 in their functioning portion is from 0.4 to 1.2 mm. They converge towards one another from the inlet orifices 24A of the manifold, each corresponding to one cylinder, to form a bundle of tubes opening in the region of the outlet flange 25 of the manifold through a substantially tubular section 30 forming the outlet of the envelope.

The tubes 20 are preferably independent of one another over their entire length. Accordingly, they are disposed contiguously in the outlet section 30. They all open in the same plane transverse to the section 30 in the region of their downstream end. At that end, each tube has a quarter-disk-shaped cross-section.

However, the tubes can come together beforehand in a forked section, thus forming a one-piece bundle leading to a single outlet orifice.

The four tubes 20 open in the same converging section made of ceramics, forming an outlet duct 31.

The four tubes and the outlet duct 31 are, but do not necessarily have to be, maintained in the radial position in the section 30 by a seal 32 formed by a ring made of a metal lattice.

The duct 31 extends through the orifice 27 and opens in the thickness of the flange 25.

Figure 2:
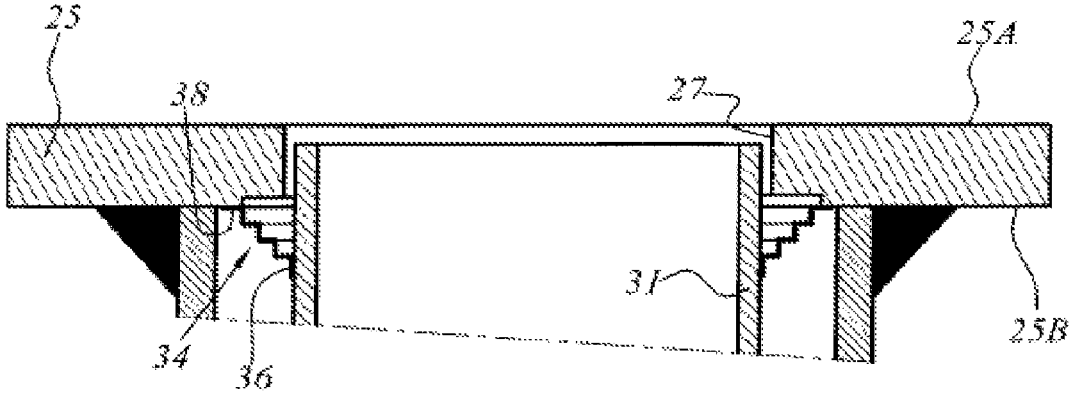
FIG. 2 is a cutaway view of the detail of the connection of the exhaust manifold and the outlet flange.

Advantageously, and as is shown in FIG. 2, a diaphragm 34 that is impermeable to gases and is radially and axially deformable in a resilient manner is interposed between the outlet duct 31 and the outlet flange 25. The diaphragm 34 thus surrounds the duct 31 and is connected to at least one of the flange 25 and the outlet duct 31. In the embodiment shown in FIG. 2, the diaphragm 34 is connected, for example, by adhesive bonding to the outer surface of the outlet duct 31. To that end it has an end collar 36. Likewise, the diaphragm is, for example, welded to the inner planar surface 25B of the flange outside the associated orifice 27. To that end it comprises a skirt 38 which is pressed against the inner surface of the flange.

The end of the diaphragm 34 that is connected to the outlet duct 31 is disposed at a distance from the flange 25 and the orifice 27.

The diaphragm 34 advantageously has a generally tapered wall converging from the flange 25 towards the outlet duct 31. Preferably, the tapered wall is in the form of a resiliently deformable bellows having a succession of tapered surfaces which are offset angularly and are connected to one another in the manner of an accordion.

For example, the bellows is formed by a stamped metal sheet having a reduced thickness of the order of from 0.1 to 0.2 mm.

While remaining generally tight, the diaphragm advantageously has a calibrated discharge vent which allows excess pressure in the inter-wall space 21 to be avoided. The vent is of such a size as to allow the air to circulate while preventing any fibres from being sucked in outside the inter-wall space and especially towards the engine or the turbocompressor.

The diaphragm 34 ensures tightness on the one hand between the exhaust line, and especially the turbocompressor, and the flange 25 and on the other hand between the flange 25 and the outlet duct 31. Accordingly, the exhaust gases do not circulate in the inter-wall space 21 delimited between the ducts 20 and the outer envelope 22.

Because the tubes 20 are made of ceramics material, they are subject to very small expansions, which permits very precise adjustment between the tubes and the outlet flange.

In addition, because the ceramics constituting the tubes 20 is a good heat insulator, very little of the heat of the exhaust gases is transferred to the solid flange 25, ensuring that the majority of the heat is guided through the manifold, thus permitting satisfactory operation of the pollution control members located downstream of the manifold, such as a catalytic purification member or a particle filter.

Figure 3:
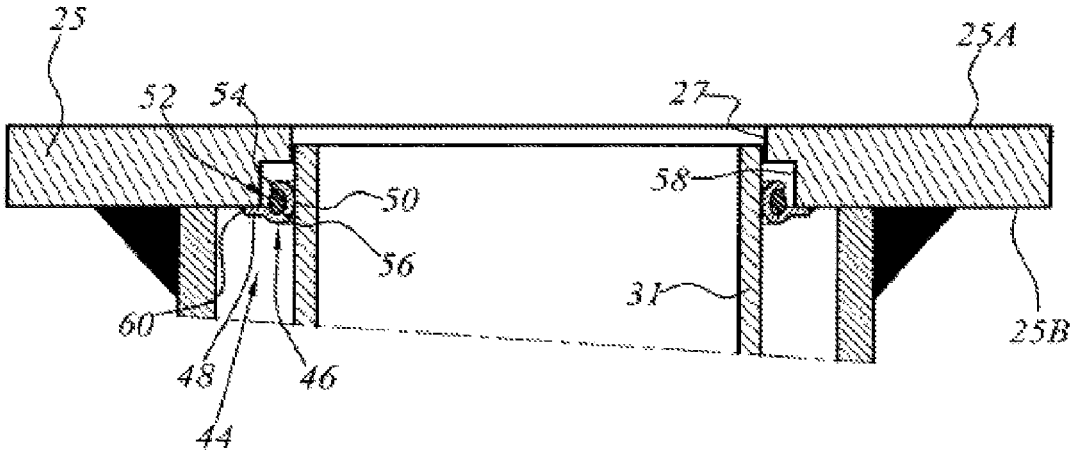
FIG. 3 is a view identical with that of FIG. 2 of a variant of the manifold and of the outlet flange.

FIG. 3 shows a variant of the coupling between the flange 25 and an outlet duct 31. In this embodiment, the diaphragm, which is denoted by reference numeral 44, is connected to the flange 25 along its inner surface 25B and is only pressed resiliently in contact with the outer surface of the outlet duct 31. To that end, the diaphragm 44 comprises a metal skirt 46 having an annular connecting region 48 pressed against the inner surface of the flange 25, and an annular profile 50 for abutment on the outer surface of the outlet duct 31. The cross-section of the skirt 46 is generally in the shape of a cross or a question mark.

The annular profile 50 delimits a channel 52 which opens on the outside opposite the associated outlet duct 31. The channel 52 has converging edges 54, so that the width of the opening of the channel is smaller than the maximum width of the channel 52.

An annular resilient member 56 formed by a resilient ring is accommodated and maintained inside the channel 52. The resilient member 56 is capable of pressing the bottom of the channel 52 against the outer surface of the outlet duct 31 by exerting a force directed towards the centre on the annular abutment profile.

The resilient ring 56 is formed, for example, by a metal lattice and has, when at rest, a diameter smaller than the outside diameter of the outlet duct 31.

In the vicinity of its inner surface, the flange has a counterbore 58 which locally widens the orifice 27. The annular abutment profile 50 and the resilient ring 56 are partially accommodated in the counterbore by being pressed against the outer surface of the outlet duct 31.

In order to hold the diaphragm 44 in position, the annular region 48 is welded at its outer periphery to the inner surface 25B of the flange by a weld line 60.

As in the preceding embodiment, the arrangement described here ensures, in view of the fact that the abutment profile 50 is held pressed against the outer surface of the outlet duct 31, tightness between the inside and the outside of the envelope of the manifold. However, if there is excess pressure in the manifold, the diaphragm 44 is deformed resiliently in the manner of a centrifuge, allowing the gas that resulted in the excess pressure to escape between the outlet duct 31 and the diaphragm.

To that end, the resilient ring 56 is such that it exerts an action directed towards the centre against the internal duct, the intensity of which action is less than that of the discharge pressure of the space between the internal duct and the outer shell.

In a different embodiment, the diaphragm 34 is fixed to the outer shell 22 rather than to the flange 25, especially in the case of an embodiment without a flange.

In another embodiment, the assembly of the outer envelope 22 is not necessarily tight. The half-shells are, for example, assembled by means of a discontinuous median peripheral weld, ensuring only mechanical holding. The same is true of the assembly of the cylinder-head flange 24 and the outlet flange 25 on the outer envelope 22.

Those different mounting solutions produce particularly advantageous solutions in terms of the tightness of the manifold.

In particular, the holding or insulating material disposed in the inter-wall space is protected.

The invention claimed is:

1. An exhaust manifold, comprising:

an outer envelope, the outer envelope comprised of an outer shell, at least one inlet flange connected to the outer shell and having at least one gas inlet orifice configured to be connected to a combustion engine, at least one gas outlet orifice, and an outlet flange connected to the outer shell and delimiting each gas outlet orifice;

one or more internal ducts arranged inside the outer envelope and opening via the at least one gas outlet orifice; and an annular diaphragm that is impermeable to gases and is radially and axially deformable in a resilient manner, said annular diaphragm arranged around each of the one or more internal ducts between each of the one or more internal ducts and the outer envelope such that exhaust gases do not circulate in an inter-wall space delimited between said internal ducts and the outer envelope, wherein the annular diaphragm is interposed between the outlet flange and each of the one or more internal ducts, wherein a periphery of the annular diaphragm is connected to at least one of i) the outer envelope and ii) each of the one or more internal ducts, and wherein the one or more internal ducts are formed, at least over a main part of a length of each duct, of a ceramics material, and are each engaged through the at least one gas outlet orifice.

2. The manifold according to claim 1, wherein the periphery of the annular diaphragm is resiliently pressed against one of i) the outer envelope and ii) the one or more internal ducts.

3. The manifold according to claim 2, wherein the annular diaphragm comprises:

a skirt, having an annular region for connection to one of the outlet flange or each of the one or more internal ducts, and an annular profile for abutment on the other of the outlet flange and each of the one or more internal ducts; and a resilient, radially acting member which is distinct from said skirt and pressed against the annular profile in order to hold the annular profile under radial stress against the other of the outer flange and each of the one or more internal ducts.

4. The manifold according to claim 3, wherein the resilient member comprises a resilient ring which encircles said annular profile, and presses said annular profile by an action directed towards a center and against the one or more internal ducts.

5. The manifold according to claim 3, wherein the resilient member encircling said annular profile exerts an action directed towards a center on the annular profile against the one or more internal ducts, and wherein an intensity of said action is less than an intensity of a discharge pressure of a space between the one or more internal ducts and the outer shell.

6. The manifold according to claim 3, wherein said profile defines an annular channel which is open to the outside and contains said resilient member.

7. The manifold according to claim 6, wherein said annular channel has two converging edges which delimit an opening having a width that is less than a maximum width of said annular channel.

8. The manifold according to claim 3, wherein a cross-section of said skirt is in the shape of a question mark.

9. The manifold according to claim 1, wherein the annular diaphragm is in the form of a bellows.

10. The manifold according to claim 9, wherein the annular diaphragm is tapered.

11. The manifold according to claim 1, wherein the annular diaphragm is connected by welding.

12. The manifold according to claim 1, wherein at least part of a space delimited between the outer shell and the one or more internal ducts contains a filling material.

13. The manifold according to claim 1, wherein the periphery of the annular diaphragm is connected to the outer envelope.

14. The manifold according to claim 1, wherein the annular diaphragm is at least partly metallic.

15. The manifold according to claim 1, wherein the annular diaphragm is rigidly fixed to at least the outlet flange.

* * * * *